US008482400B2

(12) United States Patent
Dey

(10) Patent No.: US 8,482,400 B2
(45) Date of Patent: Jul. 9, 2013

(54) APPARATUS AND METHOD FOR REMOTE ELECTRICAL CABLE MONITORING

(75) Inventor: Swapan Kumar Dey, Attleboro, MA (US)

(73) Assignee: NSTAR Electric & Gas Corporation, Boston, MA (US)

( * ) Notice: Subject to any disclaimer, the term of this patent is extended or adjusted under 35 U.S.C. 154(b) by 462 days.

(21) Appl. No.: 12/715,119

(22) Filed: Mar. 1, 2010

(65) Prior Publication Data

US 2011/0210844 A1 Sep. 1, 2011

(51) Int. Cl.
*G08B 19/00* (2006.01)

(52) U.S. Cl.
USPC ..... 340/521

(58) Field of Classification Search
USPC ..... 340/635, 521, 540, 584, 533, 539.1; 324/528, 539
See application file for complete search history.

(56) References Cited

U.S. PATENT DOCUMENTS

| | | | | |
|---|---|---|---|---|
| 5,648,726 | A * | 7/1997 | Le et al. | 324/555 |
| 5,995,588 | A * | 11/1999 | Crick | 379/22 |
| 6,798,211 | B1 * | 9/2004 | Rockwell et al. | 324/527 |
| 6,999,021 | B2 * | 2/2006 | Taylor et al. | 342/22 |
| 7,746,241 | B2 * | 6/2010 | Feight et al. | 340/635 |

* cited by examiner

*Primary Examiner* — Phung Nguyen

(74) *Attorney, Agent, or Firm* — The Farrell Law Firm, P.C.

(57) ABSTRACT

An apparatus and method for monitoring an electrical cable, wherein a sensor, which is mounted in contact with the electrical cable, monitors at least one characteristic of the electrical cable, and reports an alert when a monitored level of the at least one characteristic satisfies a predetermined condition. A termination unit, which is located within a predetermined distance from the sensor, receives a reported alert from the sensor and transmits the reported alert to a remote user device.

26 Claims, 5 Drawing Sheets

APPARATUS AND METHOD FOR REMOTE ELECTRICAL CABLE MONITORING

BACKGROUND OF THE INVENTION

1. Field of the Invention

The present invention relates generally to monitoring electrical cables, and more particularly, to an apparatus and method for remote electrical cable monitoring, wherein characteristics of an electrical cable are continuously monitored and potential malfunctions in the electrical cable are automatically reported.

2. Description of the Related Art

Monitoring of electrical cables is important to electrical utility companies in order identify potential electrical cable malfunctions, prior to a complete failure of the electrical cable.

An electrical cable carrying electric current produces an ElectroMagnetic Field (EMF), common current measurement, and heat. Currently, the measurement of the EMF and/or temperature is usually performed by conventional current transformers and temperature sensing devices. However, the use of these devices by electrical utility companies is often inconvenient as the electrical cables are often located underground (e.g., in manholes) or overhead (e.g., suspended from high towers). Accordingly, the use of these conventional devices is complex and involves a complicated installation process, as the monitoring devices are wired in line with the electrical cables.

Further, measurements are often performed using handheld devices, requiring a user to be present to test for the electrical cable EMF and temperature.

Additionally, because EMF and temperature in an electrical cable may vary with respect to time (for example, the variation of load demand will cause electrical cable current and temperature to change), a user testing electrical cable EMF and temperature using the conventional devices may not be able to find a potentially malfunctioning electrical cable.

Furthermore, testing each potentially malfunctioning electrical cable individually is a labor and cost intensive task.

SUMMARY OF THE INVENTION

The present invention addresses at least the above-described problems and/or disadvantages and provides at least the advantages and improvements as will be described below.

Accordingly, an aspect of the present invention is to provide an apparatus and method for remotely monitoring an electrical cable, such that a user does not have to be physically present to test the electrical cable EMF and temperature.

Another aspect of the present invention is to provide an apparatus and method for remotely monitoring an electrical cable, wherein the electrical cable is continuously monitored such that an occurrence of a potential malfunction can be detected.

Another aspect of the present invention is to provide an apparatus and method for remotely monitoring an electrical cable, wherein installation of the monitoring equipment is less complex than conventional monitoring devices.

Another aspect of the present invention is to provide an apparatus and method for remotely monitoring an electrical cable, wherein sensors are installed indirectly onto cables, measure the magnitude of current and temperature, and alarm at high and low level of current and/or temperature magnitudes, without the use of any external apparatus, e.g., current transformers, additional measuring instruments, etc., as well as an external power source.

In accordance with an aspect of the present invention, an apparatus is provided for remotely monitoring an electrical cable. The apparatus includes a sensor, which is mounted in contact with the electrical cable, for monitoring at least one characteristic of the electrical cable, and reporting an alert when a monitored level of the at least one characteristic satisfies a predetermined condition; and a termination unit, which is located within a predetermined distance from the sensor, for receiving a reported alert from the sensor and transmitting the reported alert to a remote user device.

In accordance with another aspect of the present invention, a method is provided for remotely monitoring an electrical cable using a sensor that is mounted in contact with the electrical cable and a termination unit that is connected to the sensor. The method includes monitoring, by the sensor, at least one characteristic of the electrical cable; reporting, by the sensor, an alert when a monitored level of the at least one characteristic satisfies a predetermined condition; receiving, by the termination unit, a reported alert from the sensor; and transmitting, by the termination unit, the reported alert to a remote user device.

In accordance with another aspect of the present invention, an apparatus is provided for remotely monitoring a plurality of electrical cables. The apparatus includes a plurality of monitor lines for monitoring at least one characteristic of each of the plurality of electrical cables, respectively; and a termination unit, connected to the plurality of monitor lines, for receiving a reported alert from one of the plurality of monitor lines and transmitting the reported alert to a remote user device.

BRIEF DESCRIPTION OF THE DRAWINGS

The above and other aspects, features, and advantages of the present invention will be more apparent from the following description when taken in conjunction with the accompanying drawings, in which.

DETAILED DESCRIPTION OF EMBODIMENTS OF THE PRESENT INVENTION

Figure 1:
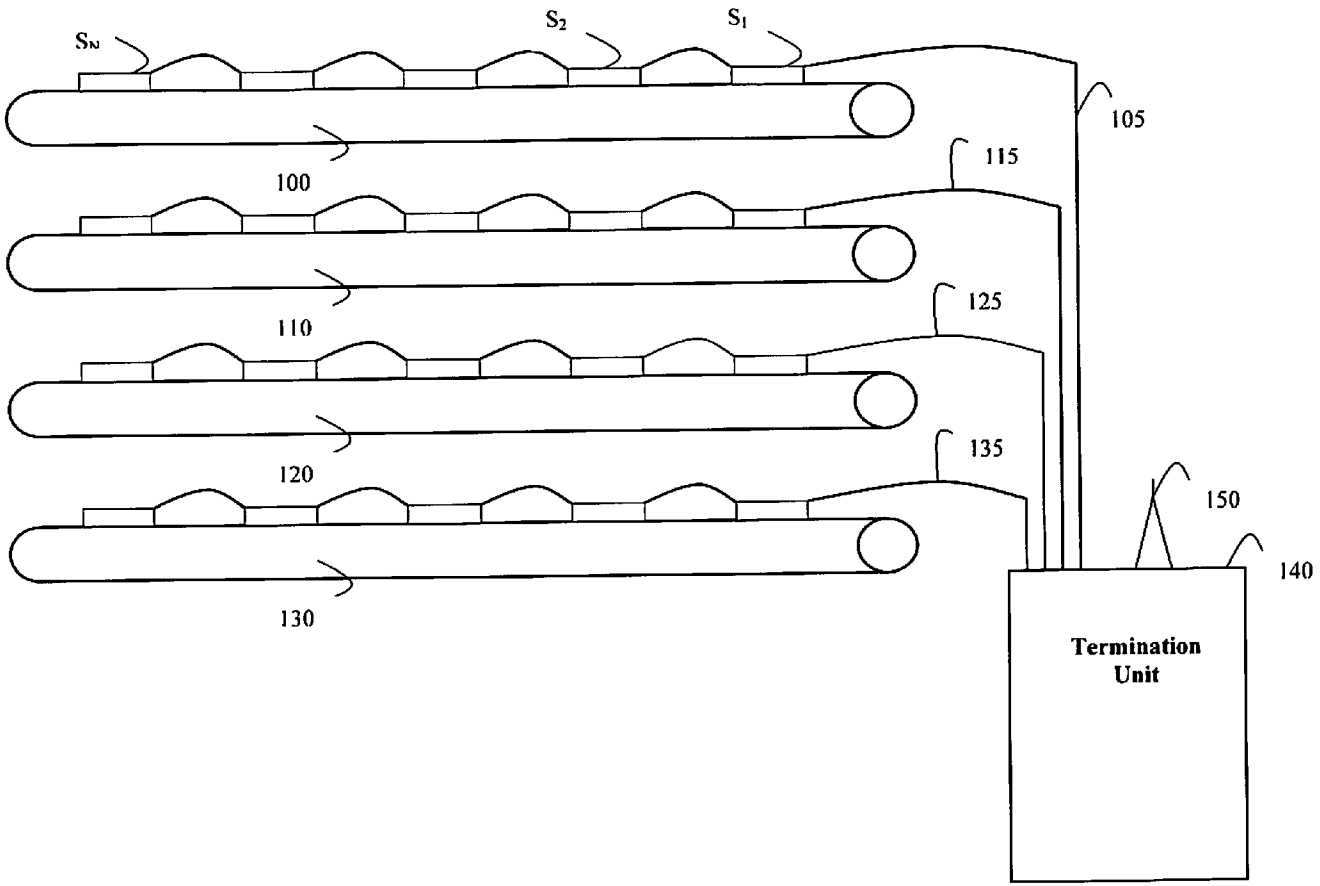
FIG. 1 is a diagram illustrating an apparatus for remotely monitoring electrical cables, according to an embodiment of the present invention.

Certain embodiments of the present invention are described in detail below with reference to the accompanying drawings. The same or similar components may be designated by the same or similar reference numerals although they are illustrated in different drawings. Further, detailed descriptions of constructions or processes known in the art may be omitted to avoid obscuring the subject matter of the present invention.

The terms and words used in the following description and claims are not limited to their dictionary meanings, but are merely used to enable a clear and consistent understanding of the invention. Accordingly, it should be apparent to those skilled in the art that the following description of embodiments of the present invention are provided for illustrative purposes only and not for the purpose of limiting the invention, as defined by the appended claims and their equivalents.

As described above, the various embodiments of the present invention, as will be described below, address the need for apparatuses and methods to remotely monitor current and temperature of electrical cables, which are not easily accessible, e.g., are underground in manholes or suspended from high towers.

FIG. 1 is a diagram illustrating an apparatus for remotely monitoring electrical cables, according to an embodiment of the present invention.

Referring to FIG. 1, the apparatus includes a plurality of monitor lines 105, 115, 125, and 135, which are connected to a termination unit 140 that transmits a reported alert from one of the monitor lines 105, 115, 125, and 135 to a remote user device. The plurality of monitor lines 105, 115, 125, and 135 are respectively coupled to a plurality of electrical cables 100, 110, 120, and 130. The termination unit may be a small control panel located in the general vicinity of the plurality of electrical cables 100, 110, 120, and 130, which preferably includes a display device that indicates and identifies a potential malfunction in one of the plurality of electrical cables 100, 110, 120, and 130.

As described above, the electrical cables 100, 110, 120, and 130 are generally located in areas that are not very accessible to people, for obvious reasons, such as underground or overhead. Accordingly, because the termination unit 140 transmits a reported alert from one of the monitor lines 105, 115, 125, and 135 to a remote user device, a user in charge of monitoring the electrical cables 100, 110, 120, and 130 does not have to go to the physical location of the electrical cables 100, 110, 120, and 130 to perform the monitoring.

More specifically, each of the plurality of monitor lines 105, 115, 125, and 135 includes a plurality of sensors $S_1$ to $S_N$ for measuring at least one characteristic of its respective electrical cable. For example, a sensor may measure a current (EMF) of the electrical cable, temperature of the electrical cable, or both current and temperature of the electrical cable. Accordingly, the sensor may be a Hall effect sensor.

The sensors $S_1$ to $S_N$ are mounted onto electrical cables 100, 110, 120, and 130 and monitor, e.g., the current and/or temperature, of the electrical cables 100, 110, 120, and 130 to determine if the monitored characteristic meets a predefined criteria, which may indicate potential malfunction of the electrical cable. For example, a current sensor monitors the current of an electrical cable to detect if the current falls below a predetermined threshold value, and a temperature sensor monitors the electrical cable temperature to detect if the temperature exceeds a predetermined threshold temperature. The threshold values for the current and the temperature will vary depending on the insulation material of the electrical cable, the material of the cable itself, and level of preciseness with which a user will want to monitor the electrical cable. Additionally, the threshold values may vary based on the ambient temperature, circulation of air around the cables, etc.

When any of the sensors $S_1$ to $S_N$ detect that a monitored characteristic meets a predefined criteria, the detecting sensor transmits an alert to the termination unit 140, which in turn transmits the reported alert to a remote user device (not shown) such as a centralized monitoring station, a mobile telephone, a Personal Computer (PC), an email device, etc. The sensors $S_1$ to $S_N$ may be connected in series through a daisy chain configuration, or may be connected in parallel.

In FIG. 1, the termination unit 140 includes an antenna 150 for wirelessly transmitting the reported alert to the remote user device. For example, the termination unit 140 may wirelessly transmit the reported alert via the Internet through a wireless network or via a wireless cellular communication network. Alternatively, the termination unit 140 may include a wired connector for transmitting the reported alert via the Internet through a wired network or via a wired telephone/data communication line.

The reported alert transmitted by the termination unit 140 to the remote user device may include an indication of the termination unit 140, an indication of the specific monitor line transmitting the alert to the termination unit 140, and/or an indication of the specific sensor transmitting the alert to the termination unit 140.

In accordance with an embodiment of the present invention, the termination unit 140 includes an indication device, such as Light Emitting Diodes (LEDs) or an LCD screen that visually identifies the sensor that detected the alert, such that a person sent to investigate potential malfunctions in an electrical cable will be able to easily identify which electrical cable and section thereof potentially has the malfunction. Preferably, the termination unit 140 is located in area that is fairly accessible to a user, e.g., just inside a manhole or at the base of a tower.

FIG. 1 merely illustrates four electrical cables as an example, and the present invention is not any way limited thereto. Further, although each of the monitor lines 105, 115, 125, and 135 is illustrated with the same number of sensors ($S_N$), the number of sensors provide on each monitor line may vary based on user preference.

Alternatively, although FIG. 1 illustrates the sensors $S_1$ to $S_N$ transmitting the alert to the termination unit 140 via the wired monitor lines 105, 115, 125, and 135, in accordance with another embodiment of the present invention, the sensors $S_1$ to $S_N$ may wirelessly transmit the alert to the termination unit 140 using any sort of short range wireless communication technique, e.g., Bluetooth or WiFi.

Figure 2:
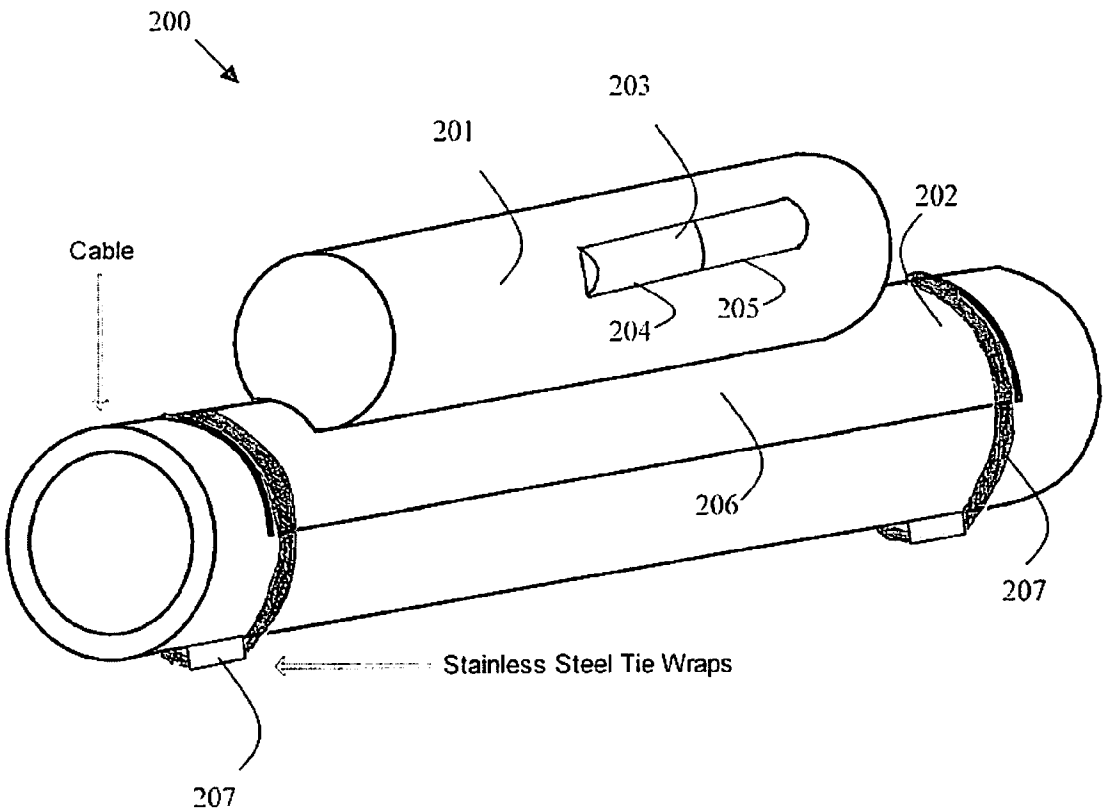
FIG. 2 illustrates a sensor for monitoring an electrical cable, according to an embodiment of the present invention.

FIG. 2 illustrates a sensor for monitoring an electrical cable, according to an embodiment of the present invention.

Referring to FIG. 2 a sensor 200 includes a sensing device 201, e.g., a Hall effect sensor, an indicator 203, e.g., a plurality of LEDs 204 and 205, and a mounting device 202.

The mounting device 202 includes a mounting portion 206 for receiving the sensing device 201 and for positioning the sensing device 201 on an electrical cable. Further, the mounting device 202 includes a plurality of fasteners 207, such as stainless steel bands or plastic tie wraps, for fastening the sensor 200 securely to the electrical cable.

The indicator 203 including the LEDs 204 and 205 is used to indicate the present state of the sensor 200. The LEDs 204 and 205 may be different colors. For example, the LED 204 may be powered on to show that the sensor 200 is operating normally and the LED 205 may be powered on to show that the sensor 200 has detected an alert. The LED 205 provides a visual indication for a person sent to investigate the electrical cable, after the reported alert has been transmitted. Therefore, in accordance with an embodiment of the present invention, after the alert has been detected, the LED 205 remains powered on until turned off by a user at the sensor 200.

Figure 3:
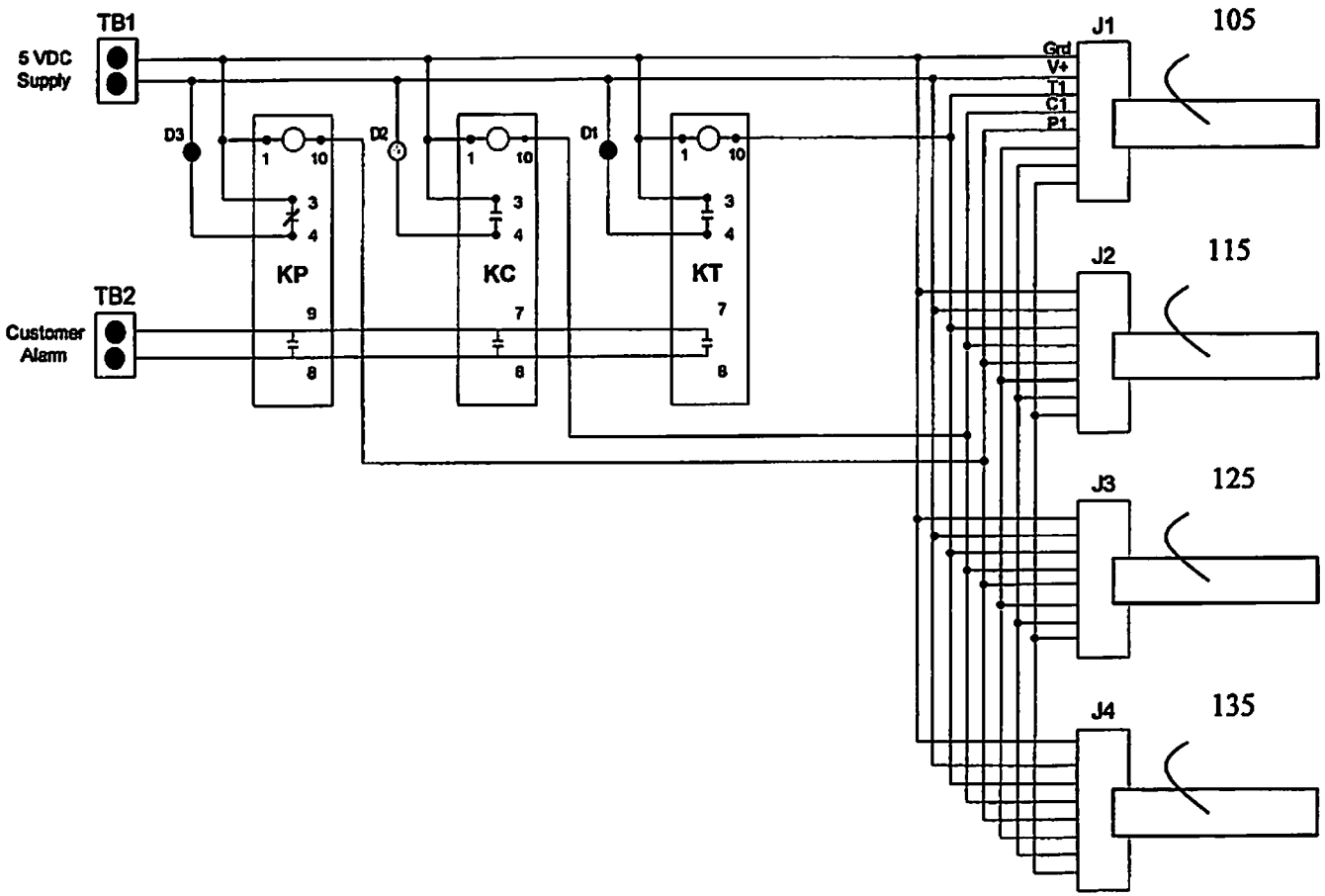
FIG. 3 is schematic diagram of a termination unit, according to an embodiment of the present invention.

FIG. 3 is schematic diagram of a termination unit, according to an embodiment of the present invention.

Referring to FIG. 3, the termination unit provides a circuit board that includes three relays KT, KC, and KP for alarming on high temperature (KT), on low current (KC), and on loss of power conditions (KP). The circuit board is also equipped with four female connectors J1, J2, J3, and J4 for supporting the four monitor lines 105, 115, 125, and 135, respectively, and includes two terminal blocks for providing power and a customer alarm. In an alternate embodiment of the present invention, the connectors J1, J2, J3, and J4 may be replaced with wireless transceivers for wireless signaling with the sensors $S_1$ to $S_N$.

The alarm conditions are:

High Temperature: When a high temperature condition occurs, i.e., a sensor detects a temperature exceeding a predetermined threshold temperature, relay KT will receive a signal from the temperature sensor and close the contact to the customer alarm.

Low Current: When a low current condition occurs, i.e., a sensor detects a current below a predetermined threshold value, relay KC will receive a signal from the current sensor and close the contact to the customer alarm.

Loss of Power: When a loss of power condition occurs, i.e., a sensor detects no current, relay KP will close the contact to the customer alarm.

Figure 4:
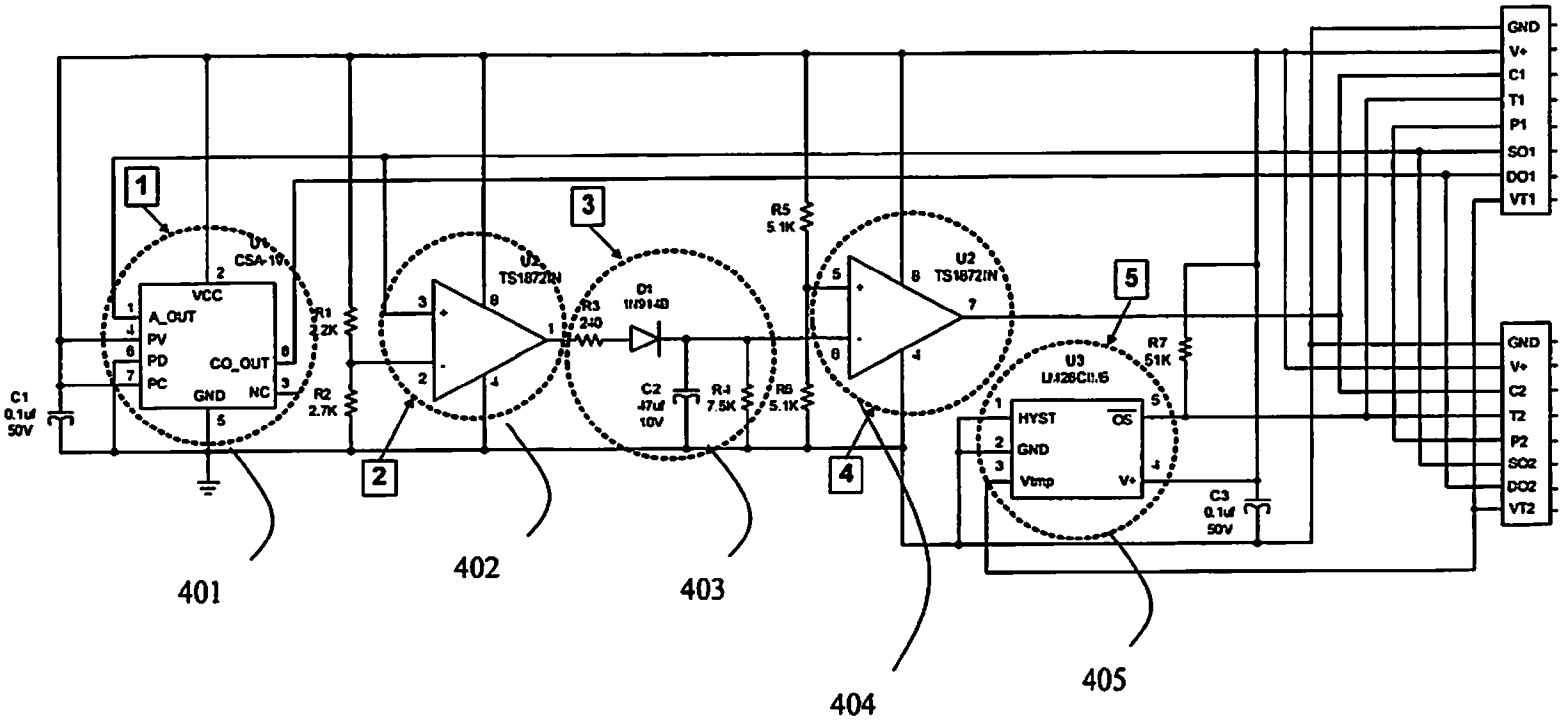
FIG. 4 is schematic diagram of a sensor, according to an embodiment of the present invention.

FIG. 4 is schematic diagram of a sensor, according to an embodiment of the present invention.

Referring to FIG. 4, the sensor includes a current sensor 401, a first amplifier 402, an Analog to Digital (A/D) Converter 403, a second amplifier 404, and a temperature sensor 405.

As described above, the current sensor 401 detects current in a monitored electrical cable by reacting to an EMF created by current flowing through the electrical cable. More specifically, the current sensor 401 generates a voltage that is proportional to the EMF. An output voltage between 0 and 5 volts is developed between pins 1 and 5 on current sensor 401. When the output voltage is greater than 2.7 volts the first amplifier 402 will be saturated and a pulse train will be generated between pins 1 and 4 of the first amplifier 402.

The pulse train is then converted by the A/D Converter 403 into a DC signal. When the DC signal is less than 2.5 volts the output will go from low to high and an alarm will be defined between pins 7 and 4 of the second amplifier 404.

The temperature sensor 405 measures cable temperature. Utilizing factory programming, the temperature sensor 405 can be manufactured with different trip points. The trip point can be preset at the factory to any temperature in the range of −55° C. to +110° C. in 1° C. increments. For example, an alarm condition may be defined as a temperature measured above 85° C.

Figure 5:
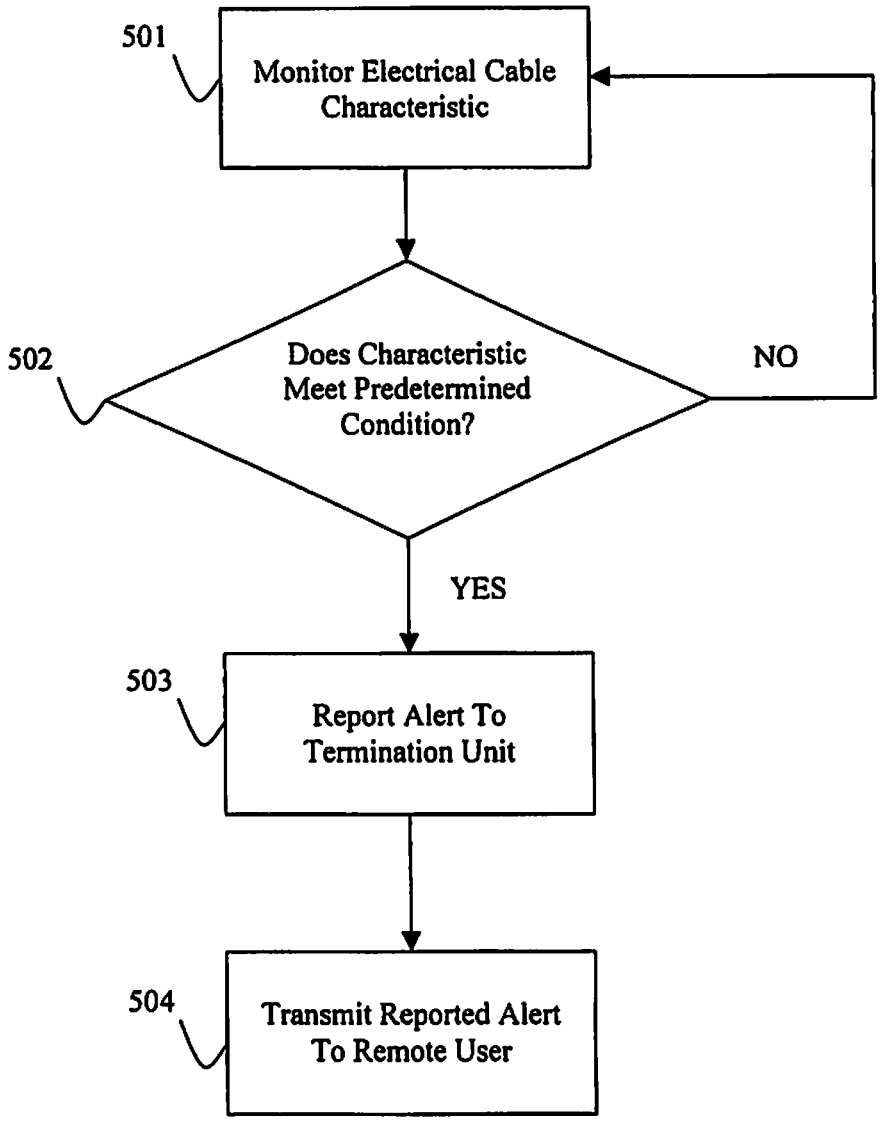
FIG. 5 is flow chart illustrating a method of remotely monitoring electrical cables, according to an embodiment of the present invention.

FIG. 5 is flow chart illustrating a method of remotely monitoring electrical cables, according to an embodiment of the present invention.

Referring to FIG. 5, in step 501, a sensor monitors a characteristic of an electrical cable. For example, the sensor may be monitoring current and/or temperature of the electrical cable.

In step 502, the sensor determines if the characteristic of the electrical cable meets a predefined criteria. For example, when monitoring current, a current sensor monitors the current of the electrical cable to detect if the current falls below a predetermined threshold value, and when monitoring temperature, a temperature sensor monitors the electrical cable temperature to detect if the temperature exceeds a predetermined threshold temperature. If the sensor determines that the characteristic of the electrical cable does not meet the predefined criteria, the sensor continues monitoring the characteristic in step 501. However, if the sensor determines that the characteristic of the electrical cable does meet the predefined criteria, the sensor reports an alert to a termination unit in step 503. In step 504, the termination unit transmits the reported alert to a remote device of a user, thereby notifying the user of a potential malfunction in the electrical cable.

As described above, the apparatuses and methods in accordance with the embodiments of the present invention remotely monitor a characteristic of an electrical cable, and when a potential malfunction is detected in the electrical cable, an alert is transmitted to a remote device of user. This may help prevent potential cable faults and other events, which may cause public inconveniences.

While the present invention has been shown and described with reference to certain embodiments thereof, it will be understood by those skilled in the art that various changes in form and detail may be made therein without departing from the spirit and scope of the present invention as defined by the appended claims and their equivalents.

What is claimed is:

1. An apparatus for remotely monitoring an electrical cable, comprising:

a sensor, which is mounted in contact with the electrical cable, for monitoring at least one characteristic of the electrical cable, and reporting an alert when a monitored level of the at least one characteristic satisfies a predetermined condition; and a termination unit, which is located within a predetermined distance from the sensor, for receiving a reported alert from the sensor and transmitting the reported alert to a remote user device, wherein the at least one characteristic of the electrical cable comprises an Electro Magnetic Field (EMF) of the electrical cable, and wherein the sensor reports the alert when the monitored level of the EMF falls below a predetermined level.

2. The apparatus of claim 1, wherein the at least one characteristic of the electrical cable further comprises:

a temperature of the electrical cable.

3. The apparatus of claim 1, wherein the at least one characteristic of the electrical cable further comprises a temperature of the electrical cable, and wherein the sensor reports the alert when the monitored level of the temperature exceeds a predetermined temperature.

4. The apparatus of claim 1, wherein the sensor comprises a visual indicator for indicating an occurrence of the alert.

5. The apparatus of claim 4, wherein the visual indicator indicates the occurrence of the alert until being reset by a user.

6. The apparatus of claim 4, wherein the visual indicator comprises a Light Emitting Diode (LED).

7. The apparatus of claim 1, wherein the sensor is wirelessly connected to the termination unit.

8. The apparatus of claim 1, further comprising at least one additional sensor, each of the at least one additional sensor being mounted in contact with the electrical cable, for monitoring at least one characteristic of the electrical cable, and reporting an alert when the monitored level of the at least one characteristic satisfies a predetermined condition.

9. The apparatus of claim 8, wherein the at least one additional sensor is connected to the termination unit in a daisy chain configuration through the sensor.

10. The apparatus of claim 8, wherein the reported alert transmitted to the remote user device by the termination unit includes an indication of which of the sensor and the at least one additional sensor is reporting the alert.

11. The apparatus of claim 1, wherein the termination unit comprises a wired network connector for connecting the termination unit to a network, and wherein the reported alert is transmitted to the remote user device via the network.

12. The apparatus of claim 1, wherein the termination unit comprises a wireless network connector for connecting the terminal unit to a network, and wherein the reported alert is transmitted to the remote user device via the network.

13. A method for remotely monitoring an electrical cable using a sensor that is mounted in contact with the electrical cable and a termination unit that is connected to the sensor, the method comprising:

monitoring, by the sensor, at least one characteristic of the electrical cable;

reporting, by the sensor, an alert when a monitored level of the at least one characteristic satisfies a predetermined condition;

receiving, by the termination unit, a reported alert from the sensor; and transmitting, by the termination unit, the reported alert to a remote user device, wherein monitoring the at least one characteristic of the electrical cable and reporting the alert when the monitored level of the at least one characteristic satisfies the predetermined condition comprises:

monitoring, by the sensor, an Electro Magnetic Field (EMF) of the electrical cable; and reporting, by the sensor, the alert when the monitored level of the EMF falls below a predetermined level.

14. The method of claim 13, wherein monitoring the at least one characteristic of the electrical cable and reporting the alert when the monitored level of the at least one characteristic satisfies the predetermined condition, further comprises:

monitoring, by the sensor, a temperature of the electrical cable; and reporting, by the sensor, the alert when the monitored level of the temperature exceeds a predetermined temperature.

15. The method of claim 13, further comprising activating, by the sensor, a visual indicator included in the sensor for indicating an occurrence of the alert, upon the occurrence of the alert.

16. The method of claim 13, wherein transmitting the reported alert to the remote user device comprises transmitting the reported alert via a wired network.

17. The method of claim 13, wherein transmitting the reported alert to the remote user device comprises transmitting the reported alert via a wireless network.

18. The method of claim 13, wherein receiving the reported alert from the sensor comprises wirelessly receiving, by the termination unit, the reported alert from the sensor.

19. An apparatus for remotely monitoring a plurality of electrical cables, comprising:

a plurality of monitor lines for monitoring at least one characteristic of each of the plurality of electrical cables, respectively; and a termination unit, connected to the plurality of monitor lines, for receiving a reported alert from one of the plurality of monitor lines and transmitting the reported alert to a remote user device, wherein each of the plurality of monitor lines, comprises at least one sensor, which is mounted in contact with an electrical cable from among the plurality of electrical cables, for monitoring the at least one characteristic of the electrical cable, and reporting an alert when a monitored level of the at least one characteristic satisfies a predetermined condition, wherein the at least one characteristic of the electrical cable comprises an Electro Magnetic Field (EMF) of the electrical cable, and wherein the at least one sensor reports the alert when the monitored level of the EMF falls below a predetermined level.

20. The apparatus of claim 19, wherein the at least one characteristic of the electrical cable further comprises:

a temperature of the electrical cable.

21. The apparatus of claim 19, wherein the at least one characteristic of the electrical cable further comprises a temperature of the electrical cable, and wherein the at least one sensor reports the alert when the monitored level of the temperature exceeds a predetermined temperature.

22. The apparatus of claim 19, wherein the at least one sensor comprises a visual indicator for indicating an occurrence of the alert.

23. The apparatus of claim 22, wherein the visual indicator indicates the occurrence of the alert until being reset by a user.

24. The apparatus of claim 22, wherein the visual indicator comprises a Light Emitting Diode (LED).

25. The apparatus of claim 19, wherein the at least one sensor is wirelessly connected to the termination unit.

26. The apparatus of claim 19, wherein the reported alert transmitted to the remote user device by the termination unit includes an indication of which of the at least one sensor is reporting the alert.

* * * * *